US005411759A

United States Patent [19]

Kawashima et al.

[11] Patent Number: 5,411,759

[45] Date of Patent: May 2, 1995

[54] ELECTRO-LUMINESCENCE INDICATING PANEL AND METHOD OF MANUFACTURE

[75] Inventors: Tomoyuki Kawashima, Yokohama; Hisato Kato, Yokosuka; Kazuyoshi Shibata, Yokohama; Harutaka Taniguchi, Yokosuka, all of Japan

[73] Assignee: Fuji Electric Co., Ltd., Japan

[21] Appl. No.: 74,566

[22] Filed: Jun. 10, 1993

Related U.S. Application Data

[62] Division of Ser. No. 751,004, Aug. 28, 1991, abandoned.

[30] Foreign Application Priority Data

Sep. 1, 1990 [JP] Japan ..... 2-230777
Apr. 2, 1991 [JP] Japan ..... 3-068654

[51] Int. Cl.[6] ..... C23C 26/00

[52] U.S. Cl. ..... 427/58; 427/66; 427/240; 427/376.2; 427/428; 427/435

[58] Field of Search ..... 427/58, 240, 428, 435, 427/66, 376.2

[56] References Cited

U.S. PATENT DOCUMENTS

| | | | |
|---|---|---|---|
| 4,277,525 | 7/1981 | Nakayama | 427/240 |
| 4,757,235 | 7/1988 | Nonumura et al. | 313/509 |
| 4,801,844 | 1/1989 | Barrow | 313/509 |
| 4,849,674 | 7/1989 | Cherry et al. | 313/509 |
| 4,885,186 | 12/1989 | Bagley | 427/376.2 |
| 4,917,958 | 4/1990 | Akai | 427/376.2 |
| 4,954,747 | 9/1990 | Tuenye et al. | 313/506 |
| 4,977,350 | 12/1990 | Tanaka et al. | 313/505 |
| 5,055,360 | 10/1991 | Ogura | 313/509 |
| 5,122,486 | 6/1992 | Kito | 427/376.2 |

FOREIGN PATENT DOCUMENTS

| | | | |
|---|---|---|---|
| 172985 | 3/1986 | European Pat. Off. | 427/66 |
| 2104726 | 3/1983 | United Kingdom . | |
| 2126416 | 3/1984 | United Kingdom . | |
| 2155689 | 9/1985 | United Kingdom . | |
| 8804467 | 6/1988 | WIPO | 313/509 |

OTHER PUBLICATIONS

J. Electrochem. Soc.: Solid State Science, "The Effects of Double Insulating Layers on the Electroluminescence of Evaporated ZnS:Mn Films", M. J. Russ et al., Oct. 1967, pp. 1066–1072.

Society for Information Display, SID Dig., "Stable High-Brightness Thin-Film Electroluminescent Panels", Toshio Inoguchi et al., 1974, pp. 84–85.

G. G. Hawley, "The Condensed Chemical Dictionary" Van Nostrand Reinhold Co. 1971, p. 660.

*Primary Examiner*—Shrive Beck
*Assistant Examiner*—Vi Duong Dang
*Attorney, Agent, or Firm*—Parkhurst, Wendel & Rossi

[57] ABSTRACT

The present invention reduces weak points in the insulation films of electro-luminescence (EL) panels by constructing, at least the lower part of the insulating film, as a coated film comprising an insulator in film form created by coating a fluidic material in an EL indicating panel which includes a light emitting film disposed between a lower electrode film and an upper electrode film, and insulation films disposed in a way that will make contact with the light emitting film; and further by forming the contours of the light emitting film parts larger than the area in which the lower and upper electrode films intersect with each other in an EL indicating panel in which the light emitting film is divided into many light emitting film parts.

11 Claims, 3 Drawing Sheets

FIG. 1
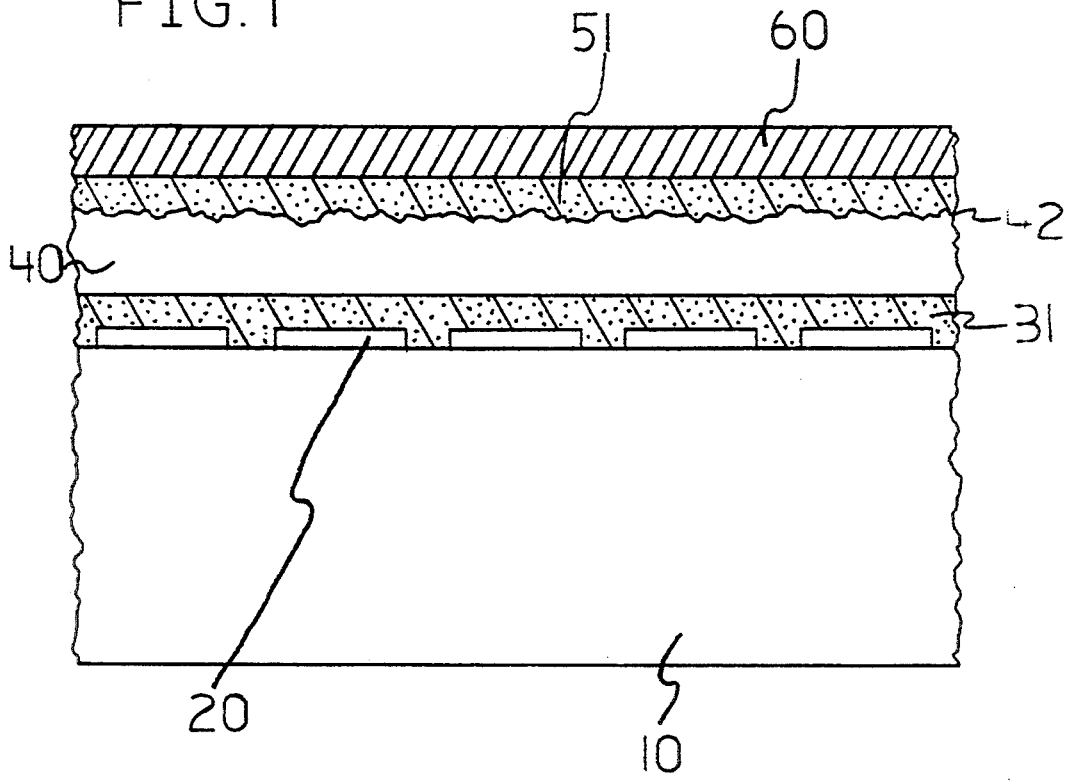
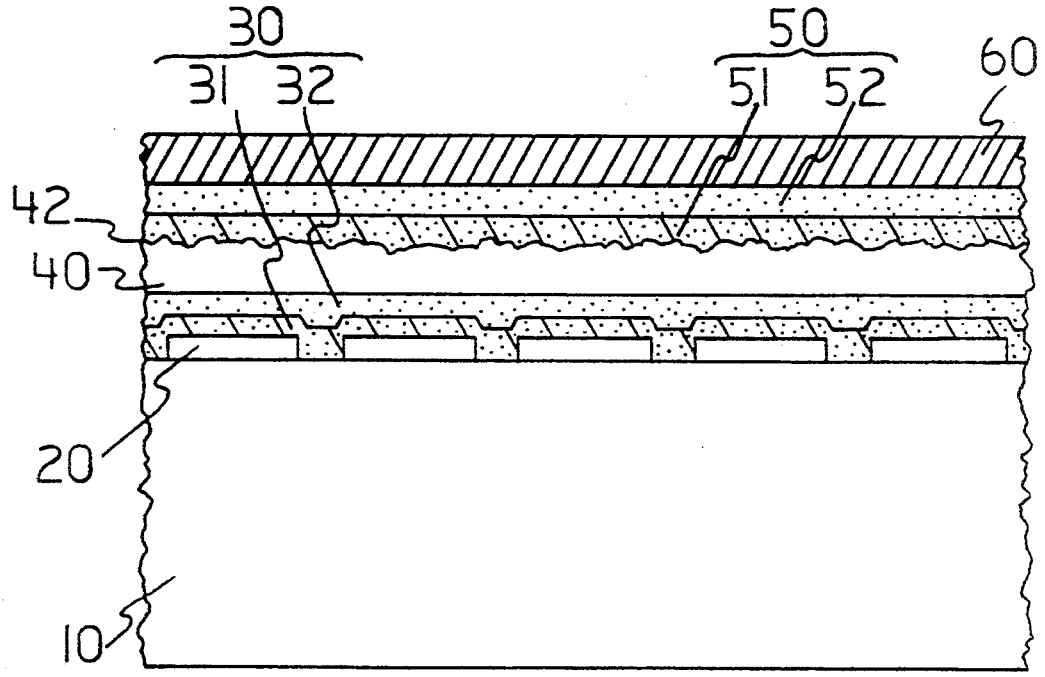
FIG. 2

(priort art)

ELECTRO-LUMINESCENCE INDICATING PANEL AND METHOD OF MANUFACTURE

This is a division of application Ser. No. 07/751,004 filed Aug. 28, 1991, now abandoned.

FIELD OF THE INVENTION

The present invention relates to an electro-luminescence (hereinafter referred to as "EL") indicating panel, created) by disposing a light emitting film between a lower electrode film and an upper electrode film, and an insulating film allowing for contact therewith, and to a method of manufacturing the EL indicating panel.

BACKGROUND OF THE INVENTION

An EL indicating panel generates electro-luminescence when an electric field is applied to a film composed of zinc sulfide with small amounts of some transition metal such as Mn and rare earth elements. EL indicating panels have been known and used for quite some time and generally consist of a thin film construction composed of a light emitting film made of the above electro-luminescence materials and an insulating film making contact therewith either from both sides or one side being sandwiched between a lower electrode film and an upper electrode film. (Refer to, for example, M. J. Russ, et al; J. Electrochem. Soc. 114, 1964, p 66, and T. Isoguchi, et al; '74 SID Intern. Symp. 1974, pp. 84–85.) Furthermore, EL indicating panels-with luminance arranged with many fine EL picture elements on the panel surface have recently become available, and they are being watched closely for their future potential as self-lighting flat panel suitable for variable images. Explanations will be given hereunder of representative examples of such EL indicating panels with thin-film construction through reference to FIG. 5.

FIG. 5 shows a partially expanded view of a substrate for the EL panel that normally uses a transparent insulation substrate (10) made of glass or similar material over which many extremely thin electrode films, measuring about 2000Å and made of ITO (indium tin oxide), are disposed as the lower electrode film (20). The lower electrode film (20) is formed in a striped pattern that is long and narrow from front to back and is arranged from right to left in a very narrow pitch of 100–150 μm, so that about eight films are usually laid within a distance of 1 mm. Then on top of this, an insulating film (30) with a thickness of about 3000Å made of a high insulation material, such as silicon nitride, a light emitting film (40) with a thickness of about 5000Å such as ZnS containing Mn, and an insulating film (50) which is identical to the insulating film (30) are laminated in that order. Next, many upper electrode films (60) with a thickness of about 5000Å, and made of a metal such as aluminum, are disposed as the uppermost layer in such a manner that they perpendicularly intersect with the lower electrode films (20) in a long and narrow striped pattern from right to left as shown in the figure, and in an identically narrow arranging pitch from front to back as shown in the figure.

Thus, the EL indicating panel has a light emitting film (40) sandwiched by the insulating films (30) and (50) between the lower electrode films (20) and upper electrode film (60), while the parts of the light emitting film (40) corresponding to the intersection area of the striped pattern in which the electrode film (20) and (60) intersect with each other constitute the picture elements for indication. All the parts in the EL indicating panel are transparent except for the upper electrode film (60). The indicating voltage is applied across the electrode films (20) and (60) so that an electric field will be applied to the light emitting film (40) via the insulating films (30) and (50). Furthermore, the electro-luminescence generated from atoms of Mn or some similar element contained in the ZnS acting as the light emitting cores will be taken out from the insulating substrate (10) as an indicating light "LD" as shown in the figure.

Because the light emitting film (40) is an insulator, both of its sides may not necessarily be sandwiched by the insulating films, and it is therefore possible to omit either one of the insulation film (30 or 50) to minimize the film thickness sufficiently to prevent atom migration which is harmful to the light emitting film (40). In addition, the insulation film must be made as thin as possible to reduce the indication voltage and raise light emitting efficiency of the light emitting film. Meanwhile, the above described film thickness allows the internal electric field strength to normally reach about $10^6$ V/cm for an indication voltage of about 200 V.

There is a problem with insulation reliability in EL indicating panels having internal electric field strength in the insulating films as high as described above, and the displayed image quality tends to be degraded while the service life is shortened as a result of local insulation breakdown which develops at various weak points on the insulation films. For instance, the weak points on the insulation are the parts, "A", as referred to the lower insulation film (30) in FIG. 5, corresponding to corner sections of the lower electrode film (20). When silicon nitride, for example, is deposited on the insulation film (30) by the sputtering process, insufficient covering or film quality defects tend to occur because of the steps created by the low electrode film (20). In addition to this drawback, the electric field is concentrated to this corner section, "A".

The upper insulation film (50) in FIG. 5 also tend to develop local insulation breakdown where it interfaces with the light emitting film (40). This is caused by the necessity of growing crystal grains (41) of ZnS or some other similar substance, as shown in FIG. 6, by applying heat treatment to improve the EL characteristics after the light emitting film (40) has been formed. This may create concaves and convexes of normally several hundred Å on the surface (42) of the light emitting film (40), tending to cause mechanical distortion or cracks at points making contact with the tips of the convexes of the crystal grains (41) of the insulation film (30) and electric field concentration on these parts, thereby resulting in insulation breakdown.

In addition, if the EL indicating panel is used for color indication, and the light emitting film (40) is divided, rather than in a continuous form as in FIG. 5, into light emitting parts (40*r*, 40*g*, and 40*b*) as shown in FIG. 7 for indications in red, green and blue, corresponding to each picture element, the parts "B" and "C" in the figure of the insulation film (30 or 50) in the vicinity of the corners will turn out weak points resulting from insufficient covering, film quality degradation, and electric field concentration, ultimately leading to insulation breakdown.

If such insulation breakdown occurs, that section will suffer an indication defect. Fortunately, however, the electrode films (20) and (60) will not immediately be short circuited in the case of an EL indicating panel, and the panel will, therefore, remain usable even though the image quality may be somewhat degraded, while the defective area will be small and will not greatly expanded. However, because a defective point tends to gradually expand (although this will vary depending on insulating film material), with the number of defects increasing slowly, any defect in the insulation film can rapidly degrade the image quality and shorten the useful life of the EL indicating panel.

For these reasons, it is an object of the present invention to reduce weak points in the insulation films of the EL indicating panel, thereby preventing the degradation of the image quality and a corresponding decrease in service life.

SUMMARY OF THE INVENTION

The present invention reduces weak points in the insulation films by constructing, at least the lower part of the insulating film, as a coated film comprising an insulator in film form created by coating a fluidic material in an EL indicating panel which includes a light emitting film disposed between a lower electrode film and upper electrode film, and insulation films disposed in a way that will make contact with the light emitting film; and by forming the contours of the light emitting film parts larger than the area in which the lower and upper electrode films intersect with each other in an EL indicating panel in which the light emitting film is divided into many light emitting film parts.

When utilizing a coated film in the above construction, it is best to construct the insulation film only by the coated film to simplify the production process. However, to obtain the best insulation withstand capacity possible with a thin film, it is desirable to form a two-layer construction using a lower coated film and an upper solid deposited film with solid insulating material deposited by a sputtering process. Also, when normally placing insulating films on both sides of a light emitting film, the coated film may be used only on one of the insulating films as required. Such a coated film may use silicon, titanium, tantalum, and aluminum compounds, and especially their oxides. The fluidic materials of these substances include alkyl silanol, alkyl titanol, pentaethoxytantalum, and tributoxyaluminum, which may be used with a suitable solvent. Synthetic resin with a high heat resistance (for example, a polyimide resin) can be used as a coated film.

When dividing the light emitting film into light emitting parts as described earlier, and forming contours larger than the area of the lower electrode film and upper electrode film that intersect each other, it is preferable to use a coated film at least in the lower part of the insulating films. In particular, in this case, it is by far more advantageous to dispose the insulating films between the light emitting film and upper electrode film, a composite film consisting of a lower coated film and the upper solid deposited film, and to place the coated film directly into contact with the light emitting film, a black insulating film.

In making the contours of the light emitting part large than the intersection area of the lower electrode films and the upper electrode film, it is preferable to make the minimum dimensions of part of the contour of the light emitting film parts swelling from the contours of the intersection area larger than the thickness of the insulating film making contact with the light emitting film parts.

In the manufacturing method for EL indicating panels using coated films in the insulating films according to the present invention, the intend object can be achieved by producing the coated films constituting at least the lower part of the insulating films through a process of applying fluidic materials, and a process of sintering thereof, as previously described.

In the application process, the fluidic materials used for the coated film as described above may be applied by spin coating, roll coating, or the dipping process. Moreover, the viscosity of the fluidic materials will be properly adjusted to best suit the application method used. For the solvent, an alcohol solvent such as isopropyl alcohol is recommended for use. Ester and ketone, or a blending of the two may also be used.

In the sintering process, the sintering of the coated film at a temperature and for the time required by a particular fluidic materials is recommended to disperse or burn off almost completely any organic contents, thereby making it an inorganic compound of silicon or metal. Since experiments have shown that it is not necessary to completely eliminate the organic contents, it is better to use this sintering process as a heat treatment process for the light emitting film.

BRIEF DESCRIPTION OF THE DRAWINGS

With the above as background, reference should now be made to be following detailed description of the preferred embodiments of the invention and the accompanying drawings, in which:

FIG. 1 is a partially expanded cross section of an EL indicating panel in accordance with a first embodiment of the present invention;

FIG. 2 is a partially expanded cross section of the EL indicating panel in accordance with a second embodiment of the present invention;

DETAILED DESCRIPTION OF THE PREFERRED EMBODIMENTS

Figure 3A:
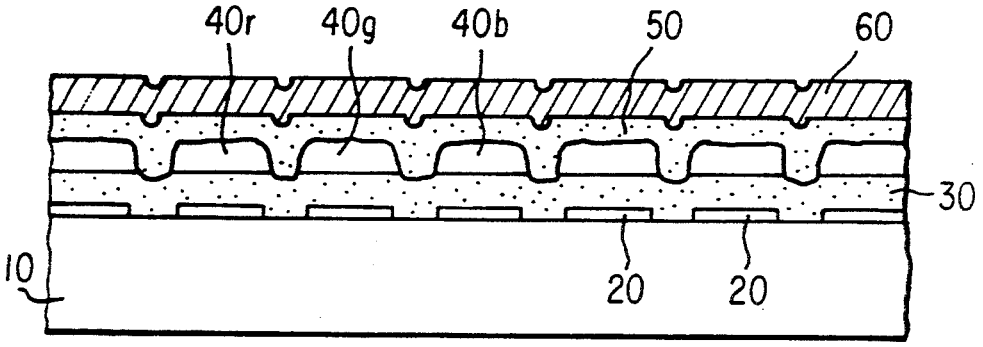
FIG. 3 (*a*) is a partially expanded cross section and FIG. 3 (*b*) is a partially expanded plan view of an EL indicating panel in accordance with a third embodiment of the invention.

The present invention can achieve the desired objective by making at least the lower part of the insulating film a coated film made of insulating materials and formed by applying fluidic materials to improve the quality of the insulating film, and coating over the steps by utilizing the fluidity of the fluidic materials that fill up the surface concaves, or by making the contours of the light emitting film parts larger than the intersection area of the lower electrode film and the upper electrode film to prevent an electric field concentration resulting from corner sections in the light emitting film parts lying over those in the lower electrode films or upper electrode film. Both of these achievements of the present invention work to reduce weak points that tend to cause local insulation breakdowns.

To explain in more detail, when the fluidic materials are applied to a foundation with steps, concaves and convexes, the fluidity of the fluidic materials fills up foundation concaves and smoothens the surface, leading to the corners of the steps on the foundation or the convexes in the concave and convex parts being fully covered with the fluidic material. When this coated film is subsequently sintered for full adhesion, the good covering of the corners and convexes in question can substantially reduce the likelihood of mechanical defects, such as local residual distortion and cracks on the coated film after sintering. The surface smoothed out as a result of the steps concaves, and convexes on the foundation being filled by coated film will improve the quality of the light emitting film and electrode films disposed on it. Since the coated film thus displays this positive effect when applied to a foundation with steps, concaves, and convexes, if it is used as part of composite film with a solidly deposited film, it should be applied to the lower side of the film. Such a composite film would have the advantage of improving the withstand pressure more by the same thickness than the single-coated film.

If the light emitting film is divided into many light emitting film parts, making the contours of the light emitting film parts larger than the intersection area of the lower electrode film and upper electrode film will eliminate the overlying of electric field concentration since the corner sections of the light emitting film parts of the insulating films will make contact with the light emitting film parts over the electric field concentration because of the corner sections of the lower electrode film and upper electrode film. This will then substantially reduce the likelihood of weak points in the insulation of the insulating films. Because the distance between the light emitting film parts is considerably small, the use of coated films in at least the lower side of the insulation film disposed over the light emitting film works more advantageously to prevent insulation weak points from developing, since the fluidic material used for this purpose fills up this narrow clearance.

Figure 4:
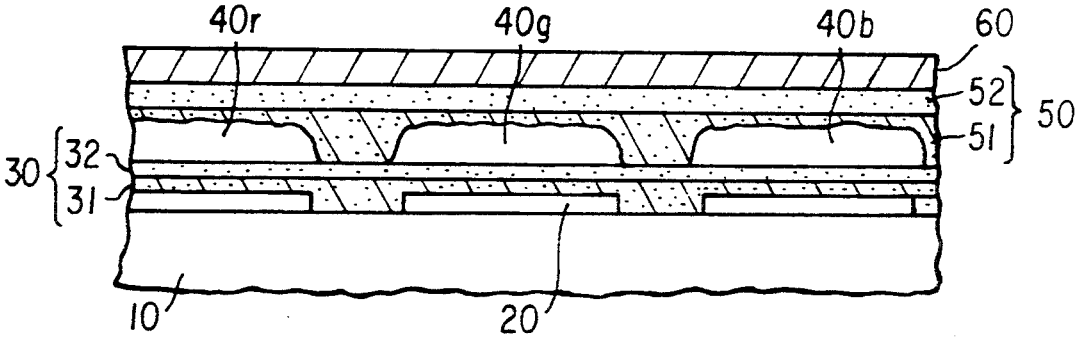
FIG. 4 is a partially expanded cross section of the EL indicating panel in accordance with a fourth embodiment of the present invention.
Figure 5:
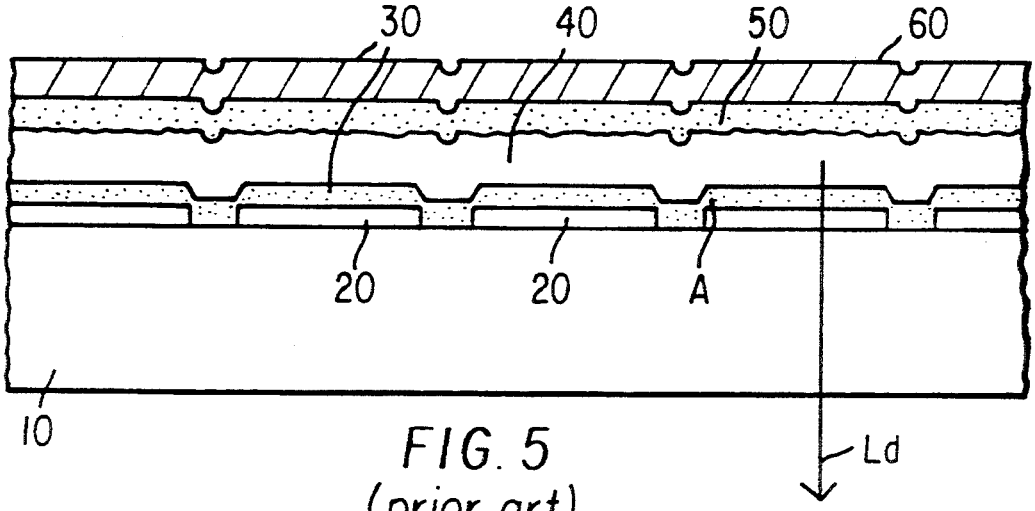
FIG. 5 (prior art)
FIG. 5 is a partially expanded cross section of a prior art EL indicating panel.

Explanations will be provided on the embodiments of the present invention by reference to the drawings. FIGS. 1 and 2 relate to the embodiments that use a coated film as the insulating film. FIG. 1 shows the first embodiment in which the insulating films are constructed by the coated film alone, while FIG. 2 shows the second embodiment which uses a coated film and solid-deposited film for the insulating films (composite films). FIGS. 3 and 4 relate to the embodiments that divide the light emitting film into light emitting film parts. FIG. 3 shows the third embodiment in which the insulating films are constructed by a solid-deposited film alone, while FIG. 4 shows a fourth embodiment using a coated film and solid-deposited film for the insulating films (composite films). The parts in these figures corresponding to those in FIG. 5 have been given the same reference numbers.

Although in all the embodiments the insulation films are to be disposed on both sides of the light emitting film or the light emitting film parts, the present invention can of course be applied to a case in which the insulation film is disposed only on one side thereof. In all of the embodiments, many thin films with a thickness of about 2000Å made of the above-mentioned ITO are disposed as the lower electrode films (20) on the insulation substrate (10) consisting of transparent material, such as glass, as has been done conventionally.

In the first embodiment shown in FIG. 1, the coated film (31) is disposed as an insulating film on the surface which has concaves and convexes made by the lower electrode films (20). The fluidic material for the coated film (31) uses an alkyl material, such as for example methyl silanol ($CH_3$ $Si(OH)_3$) dissolved with an alcoholic solvent, such as isopropyl alcohol, in a concentration of 10%, for example. With a viscosity adjusted to about 20–30 CP by solvent addition, the material is spin-coated at 2000 r.p.m., and sintered at 500°–6000° C. for about 30 minutes, to obtain a coated film (31) that has silicon oxide as its main constituent and a thickness of about 3000Å.

In this process, the fluidic material is applied more thickly in the concaves and less thickly in the convexes by the spin-coating process, making the top of the coated film nearly as flat as that shown in figure. The smallest thickness over the convexes is about 3000Å as described above. As a result, the corner sections of the electrode films (20) are fully covered by the coated film (31). The organic components in the fluidic material, such as the above-mentioned alkyl groups have the advantage of providing sufficient film thickness to the coated film (31) with a single application, and the organic components do not necessarily have to be burnt off by sintering.

Figure 6:
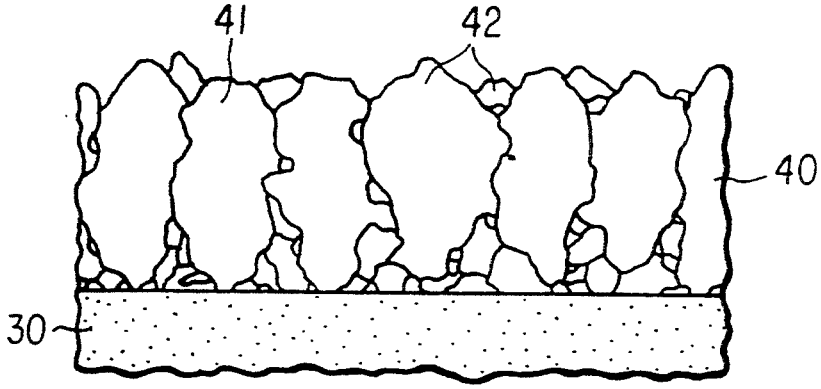
FIG. 6 is an expanded view of the essential section of FIG. 5, illustrating the problems in the prior art.
Figure 7:
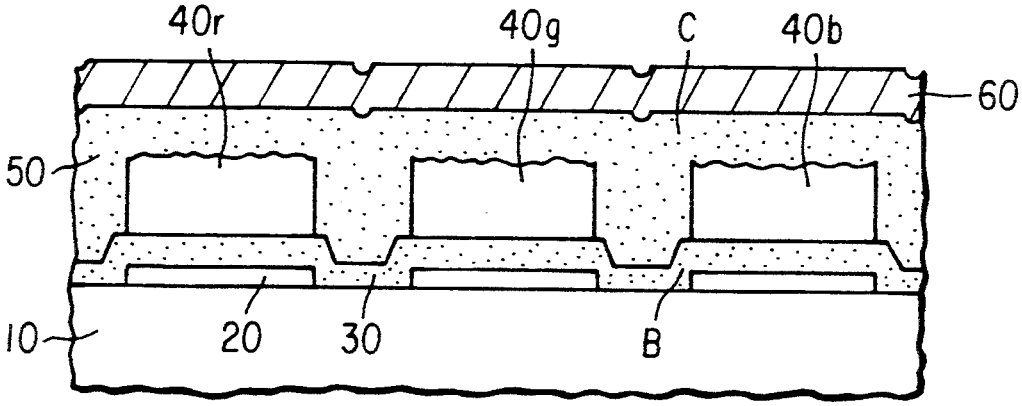
FIG. 7 (prior art)
FIG. 7 is a partially expanded cross section of a prior art EL indicating panel in which the light emitting film is divided into various light emitting film parts.

Next, ZnS containing Mn at 0.1–0.5% is formed into a film with a thickness of about 5000Å on the flattened surface of the coated film (31) by the electron beam deposition process. It is then heat-treated at 500°–600° C. for 30 minutes to obtain a light emitting film (40). The surface (42) of this light emitting film (40) produces fine concaves and convexes as shown in FIG. 6. These are then applied with the above-mentioned fluidic material in the same procedure, and sintered to a film thickness of about 3000Å as the coated film (51), to flatten out the surface of the light emitting film (40). In this first embodiment, it is possible to simultaneously carry out the heat treatment of the light emitting film (40), and the sintering of the coated films (31 or 51).

The subsequent processes are the same as those done conventionally, where as the upper electrode film (60) with a thickness of about 5000Å made of some metal, such as aluminum, and disposed on the flat surface of the coated film (51) is laid thickly from the front to the back of the figure in a striped pattern which crosses perpendicularly with the lower electrode films (20), thereby completing the construction of the panel.

In the second embodiment in FIG. 2, the insulating films (30 and 50) sandwiching the light emitting film (40) use a composite structure consisting of a coated film and a solid-deposited film. The lower side of the coated film (31) of the lower insulating film (30) is formed on the concave and convex surfaces of the lower electrode films (20) applying the same procedure as in the first embodiment, but to a thickness of about 1000Å. On this surface, the silicon nitride in this embodiment is deposited by the sputtering process to a thickness of 2000Å as the solid deposited film (32). Therefore, the total film thickness of the insulating film (30) is 3000Å, the same as in the foregoing embodiment.

The upper insulating film (50) including a coated film (51) and a solid deposited film (52), is formed on the concave and convex surfaces (42) of the light emitting film (40) to a thickness of about 1000Å in a similar manner. On this surface the alumina in this second embodiment is deposited by the sputtering process to a thickness of 2000Å as the solid deposited film (52) and forms a composite film with a total film thickness of about 3000Å. The upper electrode film (60) is formed in a similar manner as in the first embodiment.

In this second embodiment, the thin coated films (31 and 51) will cover the steps generated by the lower electrode films (20), and fill up the concaves on the surfaces of the light emitting film (40). Meanwhile, the solid deposited films (32 and 52) with a slightly greater thickness than the coated films (31 and 51) will be used to share most of the voltage, thus making it possible to increase the withstand pressure of the insulating films (30 and 50) over that of the first embodiment.

In this embodiment, it may not be necessary to make both the insulating films (30 and 50) composite, and only one side, or the lower insulating film (30), for example, may be made composite if necessary. Otherwise depending on the case, the lower insulating film (30) may be structured only with a coated film (31) with a smaller film thickness to let it take on the role of filling up the steps generated by the lower electrode films (20) on the foundation, and flatten the surface. Furthermore, the upper insulating film (50) may be structured with a composite film which has a greater film thickness to let it take on the role of sharing most of the voltage, thus differentiating the respective functions of the upper and lower insulating films.

As described above, both the first or second embodiment can prevent quality degradation of the images on an EL indicating panel in use, and extend its useful life by substantially reducing the possibility of insulation breakdown at corner sections in the steps or convex parts of the concaves and convexes by filling up the steps generated by the lower electrode films (20), and the concaves and convexes on top of the light emitting film (40) by applying fluidic materials to create a coated film that is very fluid.

In the third embodiment, shown in FIG. 3, the light emitting film is divided into many light emitting film parts, so that the EL indicating panel is a color indication type, and the contours of the light emitting film parts are made greater than the intersection area of the lower electrode films and upper electrode film, while the insulating films sandwiching this layer are formed in a similar manner as in the conventional cases. FIG. 3(*a*) shows its cross section, while FIG. 3(*b*) shows a plan view. The lower electrode films (20) and the upper electrode film (60) are structured identically with the foregoing embodiments, and the insulating films (30 and 50) consists of a silicon nitride film with silicon nitride deposited to a film thickness of about 3000Å by the same process used in conventional cases, i.e. the sputtering process.

In this third embodiment, the light emitting film is divided into three light emitting film parts, (40*r*) (40*g*) and (40*b*), which emit an electro-luminescence of red, green, and blue. These EL materials may use, for example, ZnS containing Sm, ZnS, containing Tb, or SrS containing Ce, which are formed by an electron beam deposition process or similar process into films with a thickness of about 5000Å. This process is repeated with patterning processes consisting of a dry etching process using 4-carbon chloride or 4-carbon fluoride as an etching gas. In this way, the light emitting film parts (40*r*), (40*g*), and (40*b*) are formed into the desired patterns.

In the third embodiment, the light emitting film parts (40*r*), (40*g*), and (40*b*), are patterned to greater contours than the intersection area, S, shown with the hatching of the lower electrode films (20) and the upper electrode film (60), as shown in FIG. 3 (*b*) to improve the withstand pressure of the insulating films (30 and 50). Because the contours of each light emitting film part (40*r*), (40*g*), and (40*b*) thus swell out from the contours of the intersection area, S, this area needs to be greater than the film thickness of the insulating films (30 and 50) making contact with the parts. Therefore, a setting several times greater than the film thickness is normally recommended. An EL indicating panel larger than A4 size is set at about 3 μm, although this will vary depending on the patterning accuracy of the light emitting film parts.

In the EL indicating panel of the third embodiment thus structured, there is no overlying of electric field-concentrating areas caused by the lower corner sections of the light emitting film parts (40*r*), (40*g*), and (40*b*) in the insulating film (30) in line over electric field-concentrating areas created by the upper corner sections of the lower electrode films (20) as can be seen from FIG. 3 (*b*). Also on the insulating film (50), there is no overlying of electric field-concentrating areas created by the upper corner sections of the light emitting-film parts in line over the electric field-concentrating areas created by the lower corner sections for the upper electrode film (60). Therefore, the probability of causing insulation weak points or defects in the insulating film (30 or 50) can be reduced by one or two decimal places, thereby leading to prevention of degradation in the image quality and service life of the indicating panel.

Figure 3B:
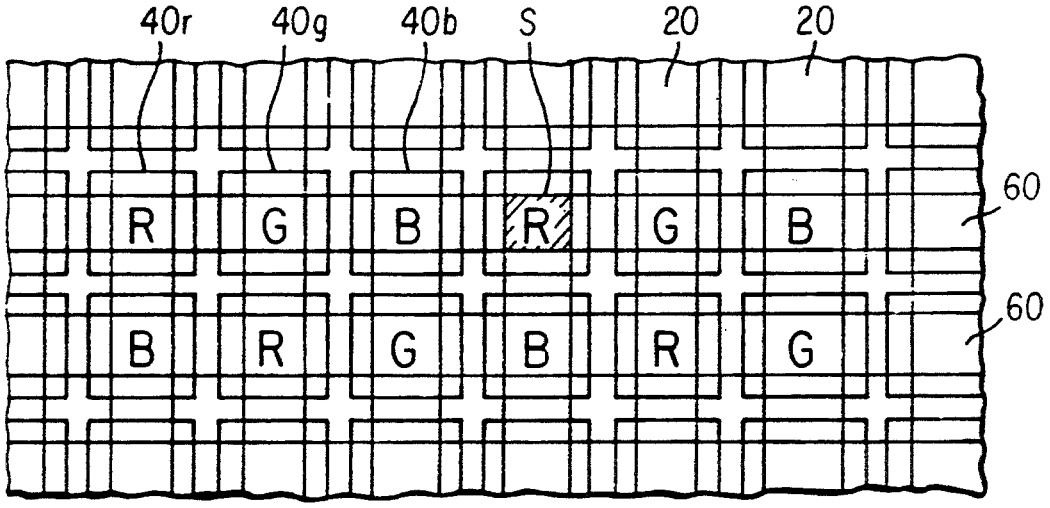

However, as can be seen FIG. 3*b*, the clearances between the light emitting film parts (40*r*), (40*g*), and (40*b*) are considerably narrow, and if these narrow clearances are insufficiently covered or filled by the upper insulating film (50), some doubt will remain that the film quality, and therefore the withstand pressure may decrease. The fourth embodiment solves this problem by taking advantage of the coated films used in the first and second embodiments.

In the fourth embodiment shown in FIG. 4, the light emitting film parts (40*r*), (40*g*), and (40*b*) are formed with the same pattern as the third embodiment, while the insulating films (30 and 50) that are in contact therewith are formed as composite films similar to those used in the second embodiment, that is, the coated films (31 and 51) with, for example, a film thickness of about 1000Å, and solid deposited films (32 and 52) with a film thickness of about 2000Å. Of all the films, the coated film (51) for the upper insulating film 50 particularly plays an important role in sufficiently filling the clearances between the light emitting film parts, and flattening the steps, while giving the effect of reducing the insulation weak points on the solid deposited film (52) disposed on its upper side, and raising the withstand pressure. Since the lower insulating film (30) has the effect of flattening the foundation that includes the light emitting film parts in addition to the insulating function, a single layer film structure consisting of the coated film (31) alone may be used as in the first embodiment. The structure used in the third embodiment can, of course, also be used depending on the case.

Furthermore, in the fourth embodiment, the coated film (51) may be made with a resin film containing black pigment or dye, by which the so-called black matrixes can be filled in the clearances between the light emitting film parts (40*r*), (40*g*), and (40*b*), each generating an electroluminescence of different colors, thereby preventing color mixing, while improving the contrast or clarity of the color indication.

Aside from the embodiments described above, the present invention can be implemented in various other patterns. The main components in the coated film may be compounds such as titanium, tantalum, and aluminum in addition to silicon oxide. Fluidic materials for the film may include, in addition to alkyl silanol, inorganic silanol or alkyl titanol, pentaethoxy tantalum, and tributoxy aluminum used with the appropriate solvents. Organic synthetic resins, including polyimide resin, can also be used. The application method can include, in addition to the spin-coating process, the roll-coating and dipping processes. Because organic components in the fluidic materials need not necessarily be burnt off completely during the sintering process, the process can ordinarily be used as a heat treatment process for the light emitting films.

As described above, the EL indicating panel of the present invention can attain the characteristics described below, by structuring at least the lower part of the insulating film using a coated film made of insulating materials, and by forming the coated films through the application and sintering of fluidic materials as a method of manufacturing thereof. For EL indicating panels, in which light emitting film is divided into light emitting film parts, the below described characteristics can be obtained by making the contours of the light emitting film parts greater than the intersection areas of the lower electrode films and the upper electrode film.

(a) As a result of disposing the coated film on at least the lower part of the insulating film, and filling up steps, concaves, and convexes on the foundation by using the fluidity of the fluidic materials used to make the film, the corner sections generated by steps, as well as the convex sections in the concaves and convexes can be fully covered. As a result, the likelihood of defects such as residual distortion and cracks is reduced in the coated films after sintering, by which the possibility of local insulation breakdown due to electric field concentration or other defects is reduced, resulting in a remarkable improvement in the long-term reliability of the insulating films.

(b) Because the steps, concaves, and convexes of the foundation are flattened out by the coated films, the number of defects in the light emitting film which makes contact with the insulating films is reduced, and the quality of the EL indicating panel can be improved. If the insulating films are structured in a composite construction, including the coated film and the solid-deposited films deposited on a flat surface of the coated film can be reduced, thereby leading to a further improvement in the reliability of the insulating films.

(c) As a result of dividing the light emitting film into light emitting film parts, while making their contours greater than those of the intersection areas of the upper and lower electrode films, the overlying of electric field-concentrating areas, caused by the corner sections of the light emitting film parts in the insulating films that are in contact the light emitting film parts in line over electric field-concentrating areas caused by the corner sections in the upper and lower electrode films can be eliminated, thereby reducing the likelihood of creating insulation weak points, and improving the reliability of the insulating films.

(d) Making the contours of the light emitting film parts greater than those of the intersection areas of the upper and lower electrode films, and using coated films at least on the lower part of the insulating film disposed on the upper side of the light emitting film parts will fill the narrow clearances between the light emitting film parts with the fluidic materials to make the coated films, prevent weak points from developing in the insulating films, and thereby, to improve the reliability of the insulating films. If the coated films are black, the EL indicating panel will be a black matrix type, and the clarity of the color indication will be improved.

As described, the present invention can prevent the degradation of the image quality of an EL indicating panel, extend the services life of the panel, and lead to remarkable improvements in the indication image quality, by removing weak points in the insulating films in contact with the light emitting film, or preventing defect generation, and, thereby, improving the long term reliability. The implementation of the present invention can contribute to the increased use of the EL indication panel, and the improvement of its performance.

What is claimed is:

1. A method of manufacturing an electro-luminescence indicating panel comprising the steps of:

forming a lower electrode film on a substrate;

forming a light emitting film on the lower electrode film;

forming an upper electrode film on the light emitting film; and forming an insulating film between at least one of the lower electrode film and the light emitting film, and the light emitting film and the upper electrode film by coating a fluidic material comprising methyl silanol dissolved in isopropyl alcohol, and sintering the fluidic material to obtain a coated film.

2. The method of claim 1, wherein the fluidic material is coated by at least one of a spin-coating method, a roll-coating method, and a dipping method.

3. The method of claim 1, wherein the step of forming an insulating film further comprises the step of depositing a solid adhered film on the coated film.

4. The method of claim 1, wherein the coated film has a substantially flat surface.

5. The method of claim 1, wherein the methyl silanol is dissolved in the isopropyl alcohol in a 10% concentration.

6. The method of claim 1, wherein the fluidic material further comprises an organic synthetic resin.

7. A method of manufacturing an electro-luminescence indicating panel comprising the steps of:

forming lower electrode films in a striped pattern on a substrate;

forming a light emitting film over the lower electrode films;

forming upper electrode films in a striped pattern over the light emitting film; and forming an insulating film between at least one of the lower electrode films and the light emitting film, and the light emitting film and the upper electrode films;

wherein the light emitting film is divided into light emitting film parts corresponding to intersection areas created by the patterns of the lower electrode films and the upper electrode films and the contours of the light emitting film parts are greater than those of the intersection areas; and wherein the step of forming an insulating film comprises the step of coating a fluidic material comprising methyl silanol dissolved in isopropyl alcohol, and sintering the fluidic material to obtain a coated film.

8. The method of claim 7, wherein the fluidic material is coated by at least one of a spin-coating method, a roll-coating method, and a dipping method.

9. The method of claim 7, wherein the step of forming an insulating film further comprises the step of depositing a solid adhered film on the coated film.

10. The method of claim 7, wherein the methyl silanol is dissolved in the isopropyl alcohol in a 10% concentration.

11. The method of claim 7, wherein the fluidic material further comprises an organic synthetic resin.

* * * * *